US007182512B2

(12) United States Patent
Bois Henri

(10) Patent No.: US 7,182,512 B2
(45) Date of Patent: Feb. 27, 2007

(54) DOUBLE GUSSET PACK

(75) Inventor: Georges Bois Henri, Neuilly sur Seine (FR)

(73) Assignee: S2F Flexico, Henonville (FR)

( * ) Notice: Subject to any disclaimer, the term of this patent is extended or adjusted under 35 U.S.C. 154(b) by 40 days.

(21) Appl. No.: 10/408,344

(22) Filed: Apr. 8, 2003

(65) Prior Publication Data

US 2003/0188514 A1 Oct. 9, 2003

(30) Foreign Application Priority Data

Apr. 9, 2002 (FR) ..... 02 04390

(51) Int. Cl.

| | |
|---|---|
| ***B65D 33/14*** | (2006.01) |
| ***B65D 33/06*** | (2006.01) |
| ***B65D 33/16*** | (2006.01) |
| ***B65D 30/20*** | (2006.01) |
| ***B65D 33/00*** | (2006.01) |

(52) U.S. Cl. ..... 383/5; 383/6; 383/61.2; 383/63; 383/64; 383/120; 383/203

(58) Field of Classification Search ..... 383/63–64, 383/5, 61.2, 203, 120, 6–7
See application file for complete search history.

(56) References Cited

U.S. PATENT DOCUMENTS

| | | | | |
|---|---|---|---|---|
| 4,877,336 | A * | 10/1989 | Peppiatt | 383/8 |
| 5,080,497 | A * | 1/1992 | Peppiatt | 383/21 |
| 5,112,138 | A | 5/1992 | Peppiatt | |
| 6,257,763 | B1 * | 7/2001 | Stolmeier et al. | 383/5 |
| 6,361,209 | B1 | 3/2002 | LaRue et al. | |
| 6,481,183 | B1 * | 11/2002 | Schmidt | 53/412 |
| 6,536,951 | B1 * | 3/2003 | Sill | 383/9 |
| 2003/0185466 | A1 * | 10/2003 | Edelman et al. | 383/5 |

FOREIGN PATENT DOCUMENTS

| | | | |
|---|---|---|---|
| GB | 2 254 065 A * | 9/1992 | 383/120 |
| GB | 2 351 035 A | 12/2000 | |
| WO | WO 92 21582 | 12/1992 | |
| WO | WO 01 17864 A1 | 3/2001 | |
| WO | WO 01 17864 A3 | 3/2001 | |
| WO | WO 02 074645 A2 | 9/2002 | |

OTHER PUBLICATIONS

French Preliminary Search Report in corresponding FR 02 04390.

* cited by examiner

*Primary Examiner*—Jes F. Pascua
(74) *Attorney, Agent, or Firm*—Finnegan, Henderson, Farabow, Garrett, & Dunner, L.L.P.

(57) ABSTRACT

The invention relates to a method for manufacturing packs (1) characterized in that it comprises steps according to which:

a packaging film is unwound;

a first gusset is formed on the unwinding packaging film;

a second gusset is formed on the unwinding packaging film, the second gusset being formed on the same edge of the unwinding film as the first gusset (3), said second gusset being associated with a closure assembly to form an opening indicator.

11 Claims, 6 Drawing Sheets

DOUBLE GUSSET PACK

GENERAL TECHNICAL FIELD

The present invention relates to the field of bag packaging.

A great number of packs and a great number of systems for manufacturing them have already been proposed.

For relatively thin packs, which are generally flat when filled, known means give satisfaction on the whole. In this case, the packs are most often formed of two plane sheets welded to each other on three sides and fitted with closure means, for example complementary male/female sections placed at the pack mouth.

On the other hand up till now, the manufacture of packs intended to receive thick contents, of whatever type, has not proved completely satisfactory, despite the not inconsiderable research that has been undertaken in this very particular field.

In FIGS. 1 and 2 appended, known packs have been shown diagrammatically. The pack shown in FIG. 1 is described in the document FR 1 550 448. The pack shown in FIG. 2 is described in the document WO 01/17864.

Of these packs, the pack 1 comprises in one of its walls 2 a gusset 3 located next to a closure assembly 4 located at the mouth 10 of said pack.

In these embodiments, the fastening units 4 are welded or bonded to the walls 2. They comprise complementary closure sections 5 comprising a slider 6 as an aid to opening.

The pack described in FIG. 1 does not include an opening indicator. Conversely, the pack 1 in FIG. 2 does include such an opening indicator. The opening indicator comprises a gauze 7 visible in FIG. 2. The gauze has come from material on the closure assembly 4. It constitutes an opening indicator gauze. Indeed, the gauze 7 is broken when the pack is first opened. It therefore shows the user whether the pack has already been opened once.

It is not easy to fasten closure means having an opening indicator on packs of this type. Fastening is especially difficult as the closure assembly is located near a gusset giving the pack sufficient holding capacity for bulky contents.

PRESENTATION OF THE INVENTION

The invention proposes to overcome these drawbacks.

To this end the invention proposes a method for manufacturing bag packaging characterised in that it comprises steps according to which:

- a packaging film is unwound;
- a first gusset is formed on the unwinding packaging film;
- a second gusset is formed on the unwinding packaging film, the second gusset being formed on the same edge of the unwinding film as the first, said second gusset being associated with the closure assembly so as to form an opening indicator.

The invention is to advantage complemented by the following characteristics taken alone or in any one of their technically possible combinations:

- a closure assembly is fastened between the two ridges of the second gusset, said second gusset forming an opening indicator;
- the closure assembly has come from material on the internal surfaces of the second gusset, said second gusset forming an opening indicator;
- a ridge of the first gusset is formed having a difference in level relative to the ridges of the second gusset, said ridge reaching its highest point at a lower height relative to the ridges of the second gusset;
- the pack is associated with a handle grip;
- the handle is formed on one edge of the pack perpendicular to the closure assembly;
- the handle is formed on one edge of the pack parallel to the closure assembly;
- a handle is fastened to the film;
- the handle comprises a film fastened onto the external wall of the first gusset;
- the handle comprises two films fastened onto the internal walls of the first gusset;
- a weakness line is formed in the sag of the second gusset;
- the pack is closed once the contents have been inserted into the pack;
- the pack is closed forming a gusset;
- the pack is closed forming a fold.

The invention relates to packs produced by this method as well as to the machines for implementing the method according to the invention.

PRESENTATION OF THE FIGURES

Other characteristics, aims and advantages of the invention will emerge from the following description which is clearly illustrative and non-restrictive and which must be read in conjunction with the appended drawings in which:

FIG. 1, already commented upon, shows diagrammatically a pack according to the prior art comprising a lateral gusset;

FIG. 2, already commented upon, shows diagrammatically a pack according to the prior art comprising a lateral gusset and an opening indicator coming from a closure assembly;

Figure 6:
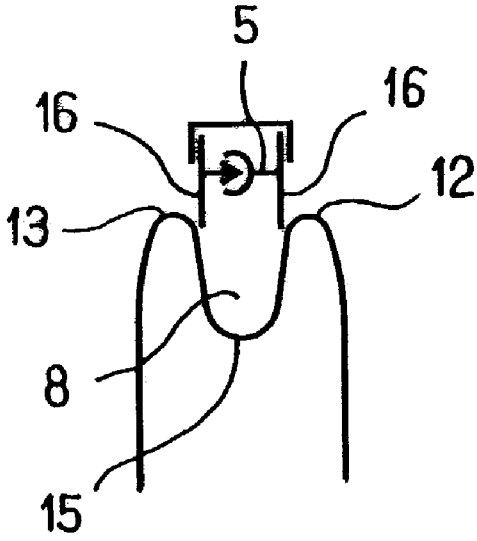
Figure 7:
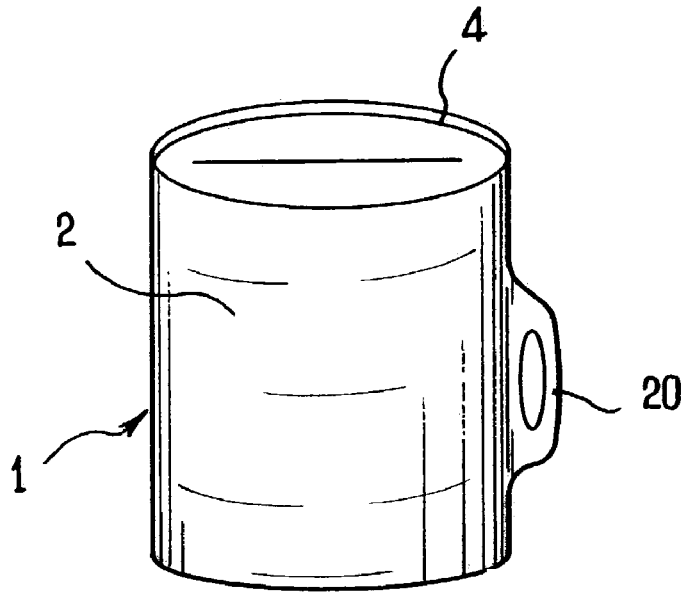
Figure 8:
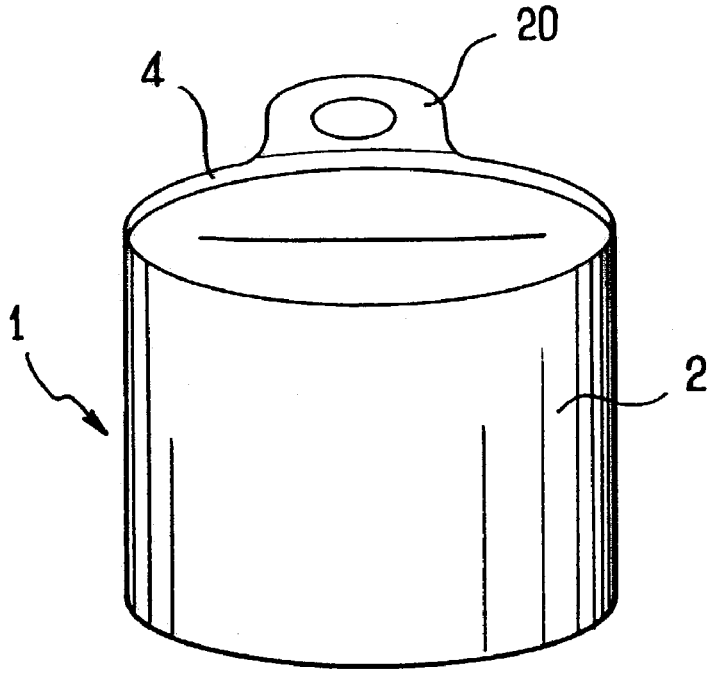
Figure 9:
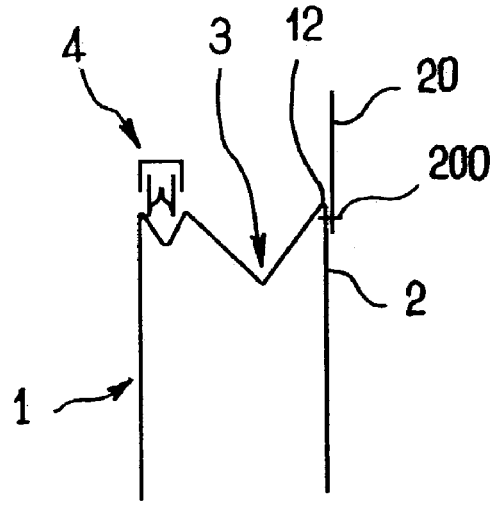
Figure 10:
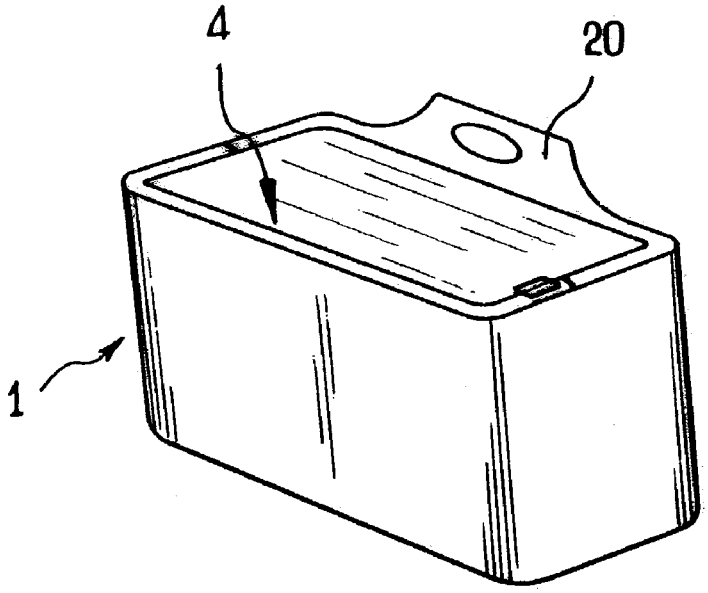
Figure 11:
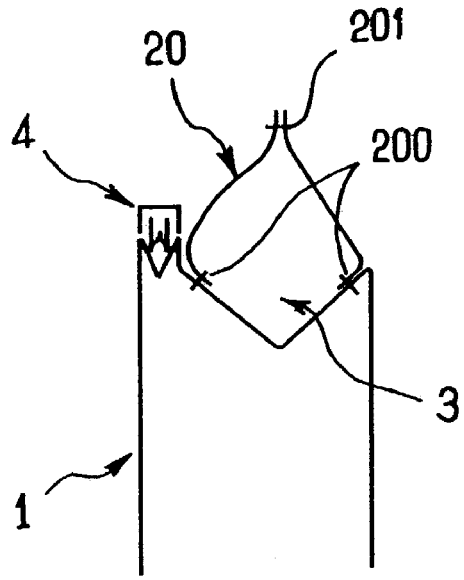
Figure 12:
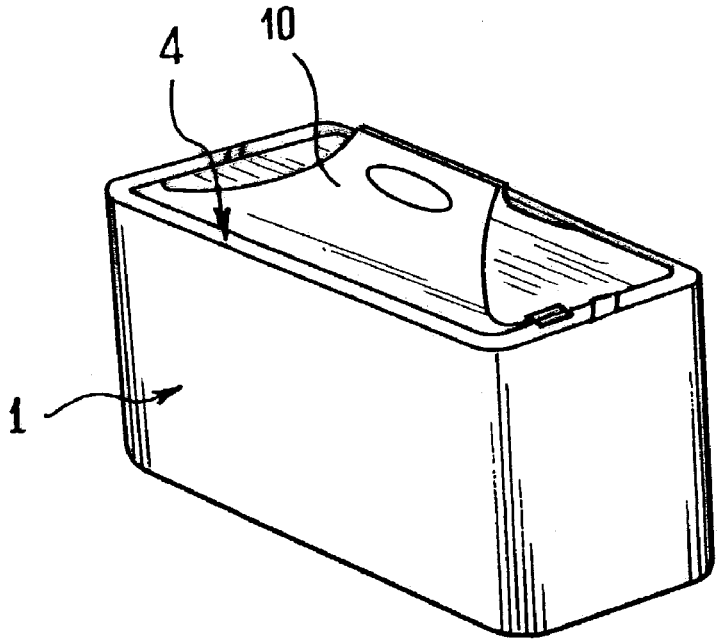

FIG. 6 a second embodiment of the closure assembly fastening gauzes;

FIG. 7 shows a first embodiment of a handle grip perpendicular to the closure assembly; and FIG. 8 shows a second embodiment of a handle grip parallel to the closure assembly;

FIG. 9 shows an embodiment of a handle grip parallel to the closure assembly, the handle being located on the gusset which does not include the closure assembly;

FIG. 10 shows the pack according to FIG. 9 when filled;

FIG. 11 shows an embodiment of a handle grip parallel to the closure assembly, the handle comprising two fastening films; and FIG. 12 shows the pack according to FIG. 11 when filled.

DETAILED DESCRIPTION

As previously indicated the present invention relates to the manufacture by automatic machine of reclosable packs, these packs comprising two gussets.

The present invention may apply both to automatic pack manufacturing machines which run horizontally and to automatic pack manufacturing machines which run vertically.

Furthermore, the present invention applies also to automatic pack manufacturing machines with filling at a stage subsequent to manufacture and possibly geographically removed from the place of manufacture, in one place and in a sequence of stages.

Figure 1:
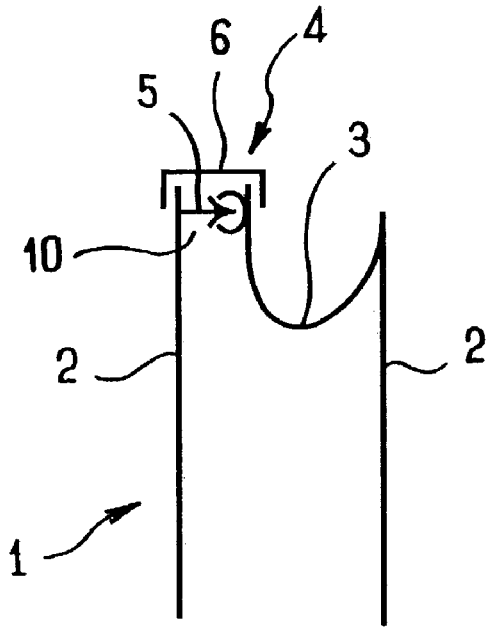
Figure 2:
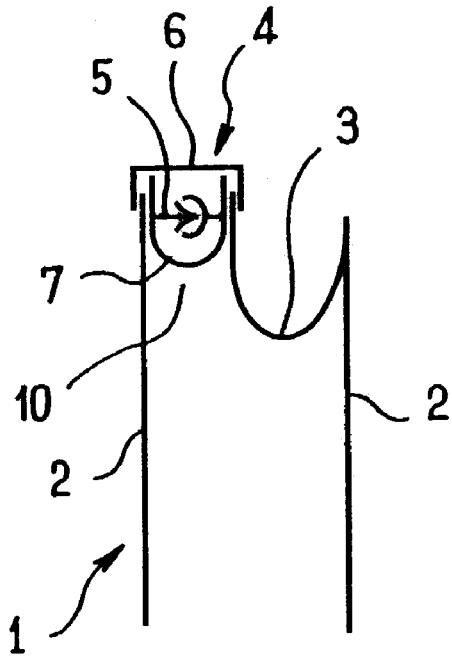
Figure 3:
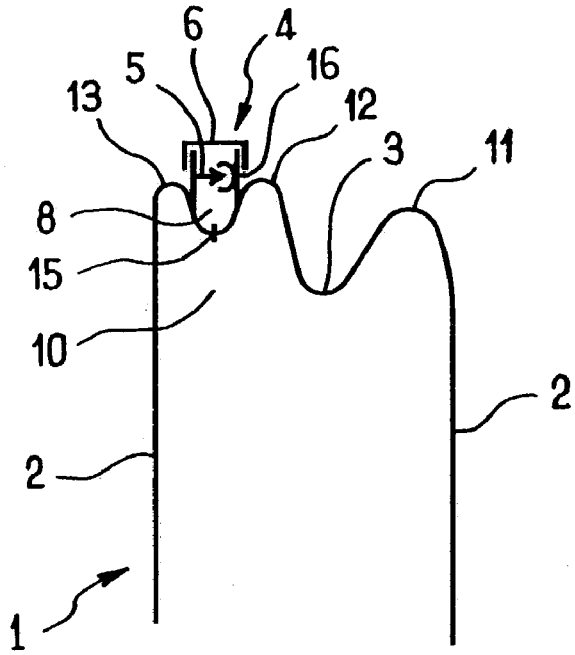
FIG. 3 shows a first possible embodiment of the invention with two gussets.

In FIG. 3 has been shown diagrammatically a first possible embodiment of a pack 1 intended to receive thick content, this pack 1 mainly comprising two walls 2 facing each other. The pack walls are formed of a packaging film.

The packaging film may be formed of any material, such as for example a plastic material, a paper or cardboard type material. The film may also be made of a composite and/or metallised.

According to the embodiment in FIG. 3, the pack 1 comprises two gussets. A first gusset is denoted 3 and a second gusset 8. The two gussets are placed on the upper part of the pack, namely on the side of the mouth 10 of the pack 1.

The gussets 3 and 8 form ridges 11, 12 and 13 and two sags located between these ridges.

The purpose of the first gusset 3 is to increase the holding capacity of the pack.

The purpose of the second gusset 8 is to form an opening indicator opposite the mouth 10 of the pack 1.

To this end, the sag of the gusset 8 comprises a weakness line 15. The weakness line may be formed of perforations formed in the film, or by a smaller film thickness. The user then breaks the weakness line 15 when first opening the pack.

According to a first embodiment, the ridges 11, 12 and 13 are approximately at the same height relative to each other.

The pack 1 comprises in its upper part a closure assembly 4 which is located between the two ridges 12 and 13 of the second gusset 8.

The closure assembly 4 is known per se and is not described in detail in the following developments. It may comprise complementary closure sections 5, for example of the male/female type, complementary fasteners or any other equivalent means.

It also comprises to advantage a slider 8 for opening and closing the sections. Conventionally, the slider comprises a base soleplate with two lateral flanges and a central rib running from it. The flanges and the rib engage so as to form two non-parallel chutes, which, depending on the direction of displacement of the slider, define convergent or divergent chutes. They therefore allow the complementary means 5 to close or to open. The slider 6 may be made of metal or plastic for example.

It also comprises fastening gauzes 16 which make it possible to connect the closure assembly between the ridges 12 and 13 of the second gusset. To advantage, the fastening gauzes have been subjected to a surface treatment that prevents their inner surfaces from being welded together when they pass between welding clamps. It should be noted that, by welding, is meant any conventional heat welding process, but also bonding processes.

The closure assembly 4 is able not to comprise complementary sections, or closing sliders.

Figure 5:
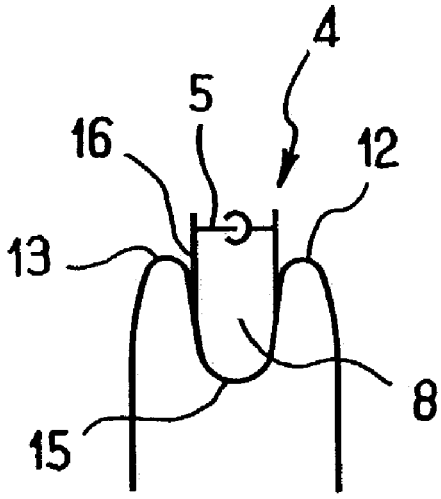
FIG. 5 shows a first embodiment of the closure assembly fastening gauzes.

FIG. 5 shows that the complementary sections 5 of the closure assembly 4 can have come from material on the ridges 12 and 13. In the embodiment in FIG. 5, the unit 4 does not consist of a closing slider but it could consist of one.

FIG. 6 shows that the fastening sections 5 may be added then welded on to the ridges 12 and 13. In this case, and they may for example have come from material on the gauzes 16 of a unit 4 separated from the ridges. The lateral gauzes 16 are of any material. The lateral gauzes may thus be made of plastic material, but also of paper or cardboard type material, composite or metallised.

Figure 4:
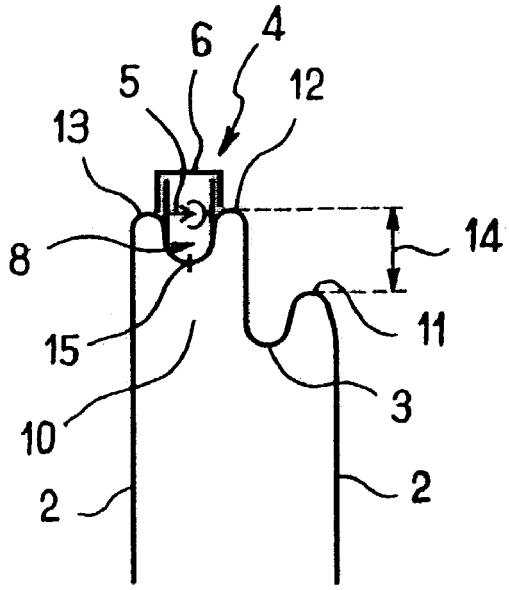
FIG. 4 shows another possible embodiment of the invention, with the two gussets offset relative to each other and having a difference in level.

FIG. 4 shows an example of another embodiment of a pack according to the invention.

The main elements are the same as the elements of the embodiment in FIG. 3. They are given similar reference numbers.

According to this embodiment, the ridge 11 of the first gusset is located below the level of the ridges 12 and 13, relative to the closure assembly 4. The difference in height 14 between the ridges 11, 12 and 13 of the gusset allows the welding means easier access to the area to be welded. Welding the fastening gauzes 16 of the closure assembly 4 added to the ridges 12 and 13 is thus easier.

The pack 1 is filled with any thick and bulky content. The content will to advantage be disposable nappies.

The pack may be filled during pack formation, when the film is being unwound on the pack forming machines. It may also be filled subsequently, at the manufacturing site or at another site.

The pack may be filled through one side perpendicular to the opening unit. The side through which the products have been inserted into the pack is welded to obtain a pack which is completely closed on all its sides. Filling may also be carried out through the side opposite the pack mouth. It is then appropriately folded to give an ideal holding capacity relative to the volume of the contents of the pack. A gusset may also be made on the side opposite the pack mouth. Lastly this side of the pack may also be welded.

FIG. 7 shows a possible embodiment of a pack 1 comprising a handle grip.

The embodiment to be seen in FIG. 7 in no way presupposes the embodiment of the ridges of the closure assembly 4. In other words, the closure assembly in FIG. 7 may equally well be made in accordance with FIG. 3, or FIG. 4.

According to the possible embodiment of the handle, the latter is provided on a side of the pack 1 which is perpendicular to the closure assembly 4.

The handle 20 may have come from material on one or other of the walls 2 of the pack 1. It may also be fixed subsequently onto the film constituting the pack or the already formed pack.

FIG. 8 shows another embodiment of the invention. According to this figure, the handle grip 20 comprises a single film and is made on a side of the pack parallel to the closure assembly 4. The handle 20 is on the side comprising the closure assembly 4. It may also be located on any one of the walls 2 of the pack 1.

FIG. 9 thus shows that the handle 20 may be located on a ridge of the gusset 3 not comprising the fastening unit 4. According to this embodiment, the handle 20 is welded, along the welding line 200, onto the external surface of the ridge 12 of the gusset which does not comprise the closure assembly 4. The handle 20 is therefore welded on the external wall 2 of the pack 1.

FIG. 10 shows the pack 1 with the handle 20 in position on the gusset 3 not comprising the closure assembly 4. The pack 1 is shown filled in FIG. 10.

The handle 20 may be formed in the wall film, or be added and fixed onto the wall after pack formation.

The handle 20 may also be constituted by two films or two gauzes.

FIG. 11 shows a handle 20 comprising two films for fastening onto the internal surfaces of the gusset 3 not comprising the closure assembly 4.

Preferentially the gauzes of the handle 20 are firstly welded onto the internal surfaces of the gusset 3. Such welding is carried out along the welding lines 200. The free ends of the handle 20 will then be welded to each other along the welding line 201.

The result of the formation of the handle 20 is shown in FIG. 12. In this figure, the pack is filled. The user thus always has access to the closure assembly and to the pack slider, and can at the same time get an easy grip on the packs.

The invention also relates to a machine for manufacturing packs according to the invention.

The manufacturing machine comprises means able to unwind a film, of plastic material, paper or cardboard for example, composite or metallised.

It also comprises means able to form two gussets side-by-side, on a same edge of the film. To advantage, the ridges of the two gussets extend parallel to the direction of unwinding of the film.

To advantage, the gusset forming means are able to form the gusset which is not intended to receive the closure assembly with a certain difference in level relative to the other gusset. This difference in level allows easier access for the means of welding the fastening gauzes of the closure assembly.

The machine is able also to comprise means for fastening the closure assembly on the gusset comprising a weakness line in its sag. The weakness line may be made by the machine, either by providing perforations in the film, or by providing a thickness in the film which is smaller. The closure assembly may be fastened to the unwinding film or at any other time during pack formation. Closure assemblies are to advantage fastened longitudinally to the unwinding of the film.

The fastening means comprise to advantage clamps for welding the fastening gauzes.

The machine may comprise means for filling the pack with its contents. To advantage, it comprises means able to fill the pack with disposable nappies.

The machine also comprises means able to close the pack once it is filled. Said means may comprise means for welding the walls of the pack to each other, and/or means able to form a fold, or a gusset on the side opposite the pack mouth.

To advantage, the machine comprises means able to form a handle grip in the unwinding film. The means are either able to form the shape of the handle then form the hole through which the hand passes, or to form the handle unit in a single operation. The machine may comprise means for fastening the handle onto the pack during its formation, or once the pack is formed and/or filled.

The films of added handles 20 are cut to the desired shape on the unwinding machine.

The handle may be fastened on one side of the pack which is perpendicular or parallel to the fastening unit.

It will be remembered that the preceding description in no way presupposes the position of the machine. For example, it may run vertically or horizontally and the closure assembly 4 may be fastened longitudinally or transversally to the unwinding of the packaging sheet or film.

The invention claimed is:

1. Pack comprising:

a first gusset formed by a first sag between a first ridge and a second ridge on a packaging film;

a second gusset formed by a second sag between the second ridge and a third ridge, the second gusset being formed on the same edge of an unwinding film, a ridge of the first gusset having a difference in level relative to the ridges of the second gusset, said ridge of the first gusset reaching its highest point at a lower height relative to the ridges of the second gusset;

a closure assembly comprising fastening gauzes connected to the film between the second and third ridge of the second gusset into internal walls of the second gusset, said second gusset then comprising an opening indicator.

2. Pack according to claim 1, which comprises a weakness line in the sag of the second gusset.

3. Pack according to claim 1, wherein a closure assembly comprises fastening gauzes coming from material on the film.

4. Pack according to claim 1, wherein a closure assembly comprises fastening gauzes added and welded onto the film.

5. Pack according to claim 1, wherein a closure assembly comprises a slider.

6. Pack according to claim 1, which comprises a handle on an edge of the pack perpendicular to an opening assembly.

7. Pack according to claim 1, which comprises a handle on an edge of the pack parallel to an opening assembly.

8. Pack according to claim 1, which comprises a handle formed of a film fastened onto the external wall of the first gusset.

9. Pack according to claim 1, which comprises a handle formed of two films fastened onto the internal walls of the first gusset.

10. Pack according to claim 1, which comprises a gusset on the side of the pack opposite the closure assembly.

11. Pack according to claim 1, which comprises a fold on the side of the pack opposite the closure assembly.

* * * * *